United States Patent [19]

Komine et al.

[11] Patent Number: 4,895,712

[45] Date of Patent: Jan. 23, 1990

[54] PROCESS FOR PRODUCING CARBON FIBER AND GRAPHITE FIBER

[75] Inventors: Kikuji Komine, Tokorozawa; Hisao Kato, Hachioji; Tsutomu Naito, Iruma; Takashi Hino, Tokorozawa; Hiroyuki Kuroda, Oomiya, all of Japan

[73] Assignee: Toa Nenryo Kogyo K.K., Japan

[21] Appl. No.: 185,110

[22] Filed: Apr. 22, 1988

[30] Foreign Application Priority Data

Apr. 23, 1987 [JP] Japan ..... 62-98524

[51] Int. Cl.[4] ..... D01F 9/12

[52] U.S. Cl. ..... 423/447.4; 423/447.1; 423/447.2; 423/447.6; 423/448; 264/29.2

[58] Field of Search ..... 423/447.1, 447.2, 447.4, 423/447.6, 448; 264/29.2

[56] References Cited

U.S. PATENT DOCUMENTS

| | | | |
|---|---|---|---|
| 4,186,179 | 1/1980 | Katsuki et al. | 423/447.2 |
| 4,193,252 | 3/1980 | Shepherd et al. | 423/447.1 |
| 4,276,278 | 6/1981 | Barr et al. | 423/447.4 |
| 4,496,631 | 1/1985 | Adachi et al. | 423/447.1 |
| 4,575,411 | 3/1986 | Uemura et al. | 423/447.1 |
| 4,582,662 | 4/1986 | Koga et al. | 423/447.4 |
| 4,656,022 | 4/1987 | Uemura et al. | 423/447.2 |

FOREIGN PATENT DOCUMENTS

| | | | |
|---|---|---|---|
| 0175200 | 3/1986 | European Pat. Off. | 264/29.2 |
| 0201213 | 11/1986 | European Pat. Off. | 423/447.6 |
| 62-78219 | 4/1987 | Japan | 264/29.2 |
| 62-133122 | 6/1987 | Japan | 264/29.2 |
| 62-156316 | 7/1987 | Japan | 264/29.2 |

*Primary Examiner*—John Doll
*Assistant Examiner*—Robert M. Kunemund

[57] ABSTRACT

A process for producing carbon fiber or graphite fiber is provided. The process comprises spinning a carbonaceous pitch, doubling spun pitch fiber bundles, adding a heat resistant doubling treatment oil, passing the fiber bundles continuously and linearly through an oxygen rich gas, infusibilizing at a temperature of 350° C. or less, then carbonizing or graphitizing infusibilized fiber bundles.

4 Claims, No Drawings

PROCESS FOR PRODUCING CARBON FIBER AND GRAPHITE FIBER

FIELD OF THE INVENTION

The present invention relates to a process for producing a carbon fiber and a graphite fiber from a carbonaceous pitch fiber, in particular, relates to a process for obtaining a long filament of carbon fiber and graphite fiber, by spinning an optically anisotropic carbonaceous pitch, infusibilizing or thermosetting the pitch fibers, then carbonizing and graphitizing them.

BACKGROUND OF THE INVENTION

Up to now, it has been strongly desired to develop a high performance of light material provided with high strength and high elasticity in widespread technical fields including automobiles, aircraft as well as the other fields of industries, thus, from this point of view, carbonaceous fibers or molded carbonaceous materials to be used for composite material have attracted a public attention. In particular, the process for producing a carbon fiber from a carbonaceous pitch has been regarded as important as a process for producing a high performance carbon fiber at a low cost.

By conventional technology, however, it is quite difficult to obtain the long filament of carbon fiber needed for high performance of products, due to the fragility of the pitch fiber because of its small tensile strength as low as 0.01 GPa.

According to the process disclosed in Japanese Patent Publication No. 12740/76 a long filament carbon fiber can be produced from a pitch fiber, by dropping and accumulating a spun yarn into a wire net basket, infusibilizing the spun yarn in the wire net basket, furthermore conducting a primary heat treatment at a temperature of 700° C. or more, thus making the tensile strength of the yarn to be 0.2 GPa or more, in addition, pulling the yarn upwards from said basket to wind it out or while winding it, carbonizing it at a temperature of about 1,500° C., thus obtaining a carbon fiber. This process, however, has a tendency to generating kinks or twists, and is liable to cause curvature of the yarn when the yarn is accumulated, which results in generating a notable irregularity of the yarn surface of the finally produced carbon fiber, and causes the yarn to be of poor appearance, in addition, it results in notably reducing the strength of the area of curvature, and causes the yarn to break frequently, thus it becomes difficult to obtain a high quality of final products. Such advantages have been impossible to be substantially improved.

In addition, a process as disclosed in U.S. Pat. No. 4,138,525 yields a carbon yarn by carbonizing after the treatment wherein by melt spinning mesophase pitch, and once winding the spun yarn on a bobbin, putting a part of the spun yarn on a wire net dish, oxidizing it under an oxidizing atmosphere at a temperature of 250° to 500° C. so as to increase the strength of the yarn, thus making the yarn easy to be processed. However, this method processes in an oxidizing atmosphere at a temperature range of 400° to 500° C., that is, oxidization is conducted at an excessively high temperature, which results in reducing the final yarn strength of the carbon fiber in the final products. Furthermore, it requires that first the yarn be once wound up, next oxidizing a part of the yarn while pulling it upwards, which results in reducing the efficiency of the production.

A process disclosed in Japanese Patent Application Laid-open Nos. 81320/85 and 21911/85 conducts a primary heat treatment (preliminary carbonizing) under a non-oxidizing atmosphere below a given temperature, after infusibilizing the wound bobbin as it is. However, these methods cause insufficient gas permeability during infusibilization or preliminary carbonization when the winding thickness of the pitch fiber on the bobbin becomes thicker. This causes fusion and sticking among the filaments, making it difficult to rewind the wound yarn on the bobbin after the primary carbonization, and results in making it liable to form a fluff of carbon fiber around the yarn on rewinding, thus remarkably reducing the merits of thus obtained carbon fiber or graphite fiber as commercial goods.

Furthermore, insufficiency of gas permeability would increase the irregularity of the degree of infusibilization, and increase the inhomogeneity of the strength of the final products of carbon fiber or graphite fiber.

These disadvantages were largely overcome by a method of utilizing the gas permeable bobbin as disclosed in Japanese Patent Application Laid-open No. 173121/85, the efficiency of manufacturing in this method, however, is not still so satisfactory, and a further improvement has been needed.

A process disclosed in Japanese Patent Application Laid-open No. 128020/80 obtains carbon fiber by melt spinning the yarn, by drawing it with a godet roller, and passing it continuously through the air-heating thermosetting furnace for infusibilization at a yarn rate of 0.15 m/min, subsequently by passing it continuously also through a carbonizing furnace. Although this method can infusibilize the yarn homogeneously so as to reduce the irregularity of its properties thus obtaining a good appearance of carbon fiber, it has a disadvantage in making the operation difficult to continue due to breakage of fiber bundle during its infusibilization, since the spinning treatment oil (finish) which is added to the fiber bundle is decomposed while the infusibilization temperature increases.

On the other hand, methods such as the one disclosed in Japanese Patent Publication No. 42696/73 have been known, wherein an air mixture containing 0.1 to 10% $NO_2$ is used as an atmospheric gas at infusibilization, and the other disclosed in Japanese Patent Application Laid-open 75828/74 wherein a mixed gas of chlorine and oxygen is used to enhance an infusibilization speed.

Although these methods have an advantage in increasing the infusibilization speed, they have disadvantages not only in generation of breakage of fiber bundles at infusibilization by passing them through linearly and continuously as thread line, but also in that explosion or burning is liable to occur since the reaction rushes in a treatment under a high temperature, in addition, the treatment of strong oxidizing gas makes the apparatus liable to corrode, which results in a short life of the apparatus.

As stated above, it has been desired to find a method which is free from breakage of fiber bundles due to disturbance of sizing performance of treatment oil, which is possible to a rapid infusibilization so as to increase the amount of production per hour, and which can obtain a high quality of the finally produced pitch base carbon fiber in long filaments without inhomogeneity of their strength, in high strength, in high elasticity, in a good appearance, and in a very small amount of fluff in treatment.

SUMMARY OF THE INVENTION

Accordingly, the first object of the present invention is to provide a method for efficiently producing pitch base carbon fiber or graphite fiber with long filaments of good appearance, in high strength, in high elasticity and in high quality.

The second object of the present invention is to provide a method for rapid infusibilization suited for a linearly and continuously integrated process on a thread line between infusibilization and heat treatment for producing carbon fiber or graphite fiber.

The aforementioned objects of the present invention have been attained by a method for producing carbon fiber and/or graphite fiber wherein infusibilizing the pitch fiber obtained by spinning carbonaceous pitch, then carbonizing or graphitizing said infusibilized fiber, characterized by a process comprising doubling the spun pitch fiber bundles, adding heat resistant doubling treatment oil of non-aqueous type during or after doubling processing, passing the fiber bundles continuously and linearly as thread line through an oxygen rich gas with 30% or more oxygen content, and infusibilizing at a temperature of up to about 350° C.

This method reduces the time of infusibilization with an increase in the speed of the infusibilization reaction as a result of high temperature and high partial oxygen pressure, since the fiber is infusibilized at a high temperature by the use of oxygen rich gas. In addition, this method reduces the time of infusibilization with a selective increase in the speed of the infusibilization of fiber surface as a result of high oxygen concentration, since the distribution of oxygen concentration in the direction of the fiber radius in infusibilization varies depending on the oxygen concentration of the infusibilization atmosphere. According to the two effects stated above, this method can rapidly infusibilize the pitch fibers, at a high temperature and in a shorter time while preventing fusion of the fibers.

DETAILED DESCRIPTION OF THE INVENTION

The term "infusibilization" used in this specification is synonymous with thermosetting. The term "fiber bundle" used herein is synonymous with a multifilament bundle, yarn, tow, or strand.

(a) Carbonaceous pitch

Carbonaceous pitch used in this invention is not limited specifically, but covers various pitches such as coal tar pitch obtained by carbonization (dry distillation) of coal, coal pitch such as coal liquefied substance, tar pitch from naphtha cracking, tar pitch from catalytic cracking, petroleum pitch from atmospheric distillation residues and vacuum distillation reidues, and synthesized pitch obtained by decomposition of synthesized resin, furthermore, hydrogenized hydrogenated substances of the aforementioned pitch by hydrogen or hydrogen donor, and reformed substances of said pitch by heat treatment or solvent extraction.

To the carbonaceous pitch of the present invention, either optically isotropic pitch or anisotropic pitch can be applied, also the pitch so called neomesophase or premesophase can be applied, the softening point, however, is preferable by about 230° to 320° C., in particular, the optically anisotropic pitch stated in the following is preferable.

(b-1) Optically anisotropic pitch

Optically anisotropic carbonaceous pitch used in the present invention means a pitch, the most part of which is substantially optically anisotropic, that is, brightness is recognized by rotating a Nicol prism fitted in a reflection polarized microscope after polishing a cross section of the solidified pitch block at an atmospheric temperature, and an optically isotropic pitch in which no brightness is recognized called optically isotropic carbonaceous pitch in this specification. Therefore, optically anisotropic carbonaceous pitch in the present specification comprises not only pure optically anisotropic carbonaceous pitch but also the case in which an optically istropic phase is contained in spherical shape or underfined shape or island in the optically anisotropic phase.

In addition, the case in which the phase is substantially optically anisotropic means the case where optically anisotropic carbonaceous pitch and optically isotropic carbonaceous pitch exist in mixture, however, the amount of optically isotropic pitch is so small that no optically isotropic pitch phase (refers to IP hereinafter) can be observed with said reflection polarized microscope, and only the optically anisotropic phase (refers to AP hereinafter) can be observed. In this connection, in general a clear boundary is observed between AP and IP.

AP in this specification may be considered to be the same as so called "mesophase", however, "mesophase" include two kinds, one containing mainly components substantially insoluble in quinoline or pyridine and the other containing mainly components soluble in quinoline or pyridine. The AP referred to in the present invention means the latter "mesophase" or containing mainly soluble components.

The aforementioned AP phase and IP phase is largely distinguished in not only its optical properties but also viscosity. It is not desirable to spin a pitch which includes both phases together because it will cause breakage of fiber or inhomogeneity of the size of the fiber. This fact means that even if the optically isotropic phase pitch includes no foreign matter undesirable to spinning, when the IP phase is not dispersed homogeneously in the AP phase, the pitch does not provide satisfactory results. From this point of view, the optically anisotropic pitch used in the present invention is required to be substantially homogeneous. Such homogeneous optically anisotropic pitch means that its IP content is 20% or less, and no solid particle of 1 $\mu$m or more in diameter is detected on the cross section with a reflection microscope, in addition, in its melt spinning temperature substantially no foaming occurs caused by any volatile matter.

In this invention, quantitative determination of AP or IP is performed by measuring an area ratio of the AP or IP portion by observation and photographing of AP or IP under a Nicol prism using a polarized microscope. The area ratio statistically represents substantially a volume %. However, a difference in specific gravity between AP and IP is so small as about 0.05. Therefore, the volume % is considered to be almost the same as the weight %.

The use of lower the softening point of the optically anistropic pitch in the present invention is preferable. The term "softening point of a pitch" as used herein refers to a solid-liquid transition temperature of the pitch. The softening point is determined by measuring the peak temperature of absorption or emission of latent heat at which the pitch melts or solidifies, using a differential scanning calorimeter. The softening point measured by this method is identical with the temperature measured by other methods such as the ring and ball method, melting point methods, etc., with an error of ±10° C.

General spinning technology can be used in the spinning of this invention. The spinning temperature suited for melt spinning is, usually 60° to 100° C. higher than the softening point of the material to be spun. On the other hand, the optically anisotropic pitch used in the present invention causes thermal cracking and polycondensation at above temperature of 380° C., and in some case results in the generation of a decomposition gas or in formation of unmelted matter. Taking this fact into consideration, the optically anisotropic pitch used in this invention is preferable one with 320° C. or less softening point, but in particular, 230° C. or more from a view point of infusibilization process which will be described later.

(b-2) Process for producing optically anisotropic pitch any suitable method may be applied to produce the optically anisotropic pitch used in this invention. The conventional method can be used that is, stirring heavy hydrocarbon oil, tar, or commercialized pitch which is generally used for producing pitch in a reactor at a temperature range of 380° to 500° C., performing thermal cracking and polycondensation to the sufficient extent, while removing volatiles with an inert gas, thus enhancing the optically anisotropic phase(refers to AP hereinafter) of the residue pitch. However, when an optically anisotropic pitch containing 80% or more AP (according to the measurement of a polarized microscope) is produced, the reaction of thermal decomposition polycondensation proceeds too far and in some cases the quinoline insoluble content will be as high as 70 weight % or more, and the softening point will be 330° C. or more. In addition, the optically isotropic phase (referred to IP hereinafter) is difficult to be in a state of dispersion with fine particles, thus said method is considered not necessarily to maintain a preferable one.

The present inventors have achieved a process for producing an optically anisotropic pitch having a large AP content which comprises discontinuing the thermal cracking and polycondensation half way, settling the thermally cracked, polycondensed product while maintaining the temperature in the range of from 350° to 400° C., precipitating AP having a high density in a lower layer while growing and ripening AP, separating the AP precipitates from IP having a low density in the upper layer and withdrawing the AP precipitates. This process was filed as Japanese Patent Application Laid-open No. 119984/82.

More preferable is the method for producing the optically anisotropic pitch used in this invention, as described in Japanese Patent Laid-open No. 180585/83, which is a process for producing an optically anisotropic carbonaceous pitch having a low softening point and a high AP content and comprises subjecting a carbonaceous pitch containing AP to an appropriate degree but not rendered excessively heavy to centrifugal separation with an acceleration of centrifugal while in the melt state, whereby the AP portion rapidly separates and precipitates. According to this method, the AP phase is collected in a lower layer (a layer toward a centifugal force) while being combined and grown, and the AP amounts to be a continuous layer of about 80% or more, in which pitch containing a small amount of IP in an island-shape or in a fine spherical shape forms the lower layer whereas an upper layer is formed of the pitch composed mainly of IP in which any AP is dispersed as fine spheres. In this case, the boundary between both the layers is so distinct that the lower layer can be separated from the upper layer. Accordingly, an easily spinnable optically anisotropic pitch is provided with a large content of AP. According to this method, a carbonaceous pitch having an AP content of 95% or more and having a softening point ranging from about 230° to 320° C. can be obtained economically within a short period of time. Such an optically anisotropic carbonaceous pitch has excellent spinning characteristics for in melt spinning. Due to its homogeneous property and high orientation carbon fibers and graphite fibers prepared thereform are excellent particularly in tensile strength and elastic modulus.

(c) Process for producing fibers (i) spinning

The pitch with a high AP content and a low softening point as described above can be spun in accordance with published methods. In such a method, for instance, that a pitch is charged in a metal-made spinning vessel equipped with 1 to 1,000 spinning nozzles spinnerets having a diameter of 0.1 to 0.5 mm at the bottom. The pitch is maintained at a temperature between 280° and 380° C. under an inert gas. When the pressure of the inert gas is increased to several hundred mm Hg while keeping the pitch in a melt state, the pitch melt is extruded from the nozzles and the fibers flown down therefrom. By controlling the temperature and atmosphere at the extruded and collected portion, the pitch fibers are then taken up and wound around a bobbin rotating at a high speed.

Furthermore, such a method can be applied that pitch fibers spun from a spinneret are collected into a collecting box at the bottom while being directed and transported by a gaseous flow. In this case, it is possible to continuously spin, when the pitch is fed into the spinning vessel in a previously melted state under the pressure using a gear pump. Further in the above method, it is also possible to withdraw the pitch fibers around the spinneret while stretching the fibers with a gas flow at a high speed at a controlled temperature and to deposit long fibers, on a belt conveyor located below the spinnerets.

A spinning method also can be used which comprises rotating a cylindrical spinning vessel having spinning nozzles around the wall at a high speed, continuously feeding a melt pitch thereto, and then collecting pitch fibers extruded from the wall of the cylindrical spinning vessel by the centrifugal force and stretched by the action of the rotation.

Any method for spinning can be applied to this invention.

In the present invention, melt spun pitch fibers are introduced into an oiling roller while directed by passing through an air sucker, and further sized by adding a spinning treatment oil (finish). As a spinning treatment oils such compounds can be used, as, for instance, water or alcohol such as ethyl alcohol isopropyl alcohol, n-propyl alcohol and butyl alcohol, or a polysiloxane such as dimethyl polysiloxane, alkyl phenyl polysiloxane alkylchloro polysiloxane and phenyl chloro polysiloxane, etc. with 3 to 300 cst viscosity (at 25° C.), diluted by a solvent such as silicone oil (polysiloxane) paraffin oil with a low boiling point, or dispersed into a water by adding an emulsifier, or graphite or polyethylene glycol and hindered esters dispersed in water, surface active agents diluted by water and various commercial spinning treatment oils not damaging to pitch fibers such as are used for the other ordinary fibers such as polyester fibers.

In addition, the same treatment oil as the heat resistant oil added after doubling, which will be described later, can be added as a spinning treatment oil at spinning.

In general, 0.01 to 10 wt % of spinning treatment oil is added to a fiber, in particular, however, 0.05 to 5 wt % is preferable.

In the present invention, when, a pitch fiber bundle is wound up around a bobbin, a traverse as large as 2 to 100 mm/(one revolution of a bobbin) at winding, and 1 to 100 mm thickness of winding, preferably 5 to 50 mm, is efficient, in order to make the stable and continuous rewinding for a long time from a state of winding. From a view point of rewinding efficiency of a pitch fiber bundle from a bobbin, a pitch of traverse is preferable to be 5 to 20 mm/(one revolution of a bobbin).

(ii) Doubling of pitch fiber bundles

In the present invention, at infusibilization, pitch fiber bundles are doubled prior to the infusibilization, for the purpose of strengthening the fiber bundles, and passing said bundles continuously and stably into the infusibilizing furnace.

The number of pitch fiber filaments of a fiber bundle spun from the melt spinning machine (a spinneret) is restricted because of the melt spinning, and it is in general 1 to 2,000, in particular, 50 to 1,000 filaments.

The present invention uses 2 to 50 pitch fiber bundles obtained by melt spinning, doubles them into 100 to 100,000, preferably, 500 to 50,000 filaments. When the number of filaments is less than 100, the strength of fiber bundles is too small, and the fiber bundles are liable to be broken when passing through the high temperature infusibilizing furnace, and the production efficiency is poor. When the number of filaments exceeds 100,000, heat is accumulated in the fiber bundles at infusibilization, and the fibers are liable to be melted and broken.

Doubling is performed by rewinding the spun pitch fiber bundles on to a plurality of bobbins at a time, doubling them into a fiber bundle, then further winding said fiber bundles around a bobbin.

The pitch of traverse at doubling is preferably 5 to 100 mm per revolution of the bobbin. A large pitch of traverse is preferable to improve the smoothness of rewinding from the bobbin, and excessively large pitch of traverse, however, is not preferable since it may damage the fibers.

Doubling may be carried out by taking up pitch fiber bundles from a plurality of collecting baskets or cases.

Doubling may be performed not only by rewinding from a plurality of bobbins, but also by directing the pitch fiber bundles spun from a plurality of spinning machines or spinnerets at a time.

Doubling of 2 to 50 pitch fiber bundles at one time may be performed, by another method, wherein first 2 to 10 pitch fiber bundles are doubled and then 2 to 10 of these are redoubled in the second stage of doubling.

For the purpose of improving the doubling efficiency and directing properties of the fiber bundles during infusibilization, a twist is applied to the filaments by 0.1 to 30 times/m, in particular, 1 to 5 times/m, during a doubling stage, as the occasion requires.

The present invention also applies, at the doubling, a heat resistant doubling treatment oil (finish) of a non-aqueous type, in order to improve the sizing properties of the fiber bundles, at infusibilization, in order to pass the bundles stabely into an infusibilizing furnace under a high temperature of 300° to 350° C. As the result of a good sizing effect, the pitch fiber bundles and infusibilized pitch fiber bundles are soft, pliable and well lubricated. In this case, as the heat resistant doubling treatment oil, alkyl phenyl polysiloxane may be adopted.

The alkyl phenyl polysiloxane preferable to contain 5 to 80 mol %, in particular, 10 to 50 mol % of phenyl groups.

In addition, methyl, ethyl and propyl groups are preferable as the alkyl group. Two or more kinds of alkyl groups may be contained in a molecule.

An alkyl phenyl polysiloxane with 10 to 1,000 cst viscosity at a temperature of 25° C. is preferred.

As another treatment oil, dimethyl polysiloxane containing an antioxidant, with 5 to 1,000 cst. preferable viscosity at a treatment of 25° C., can be used.

As the antioxidant, amines, organic selenium compounds, phenols, such as phenyl-α-naphthylamine, dilauryl selenide, phenothiazine, iron octalate can be used. These antioxidants can be added to the alkyl phenyl polysiloxane, for the purpose of enhancing further the heat resistibility.

While infusibilizing of fiber bundles under a high temperature of 300° to 350° C., these treatment oils show remarkably small amount of cracking and degradation, and the fiber bundles are free from breakage during infusibilization, and contain very small amounts of fluff filaments, and can the bundles be passed into the infusibilizing furnace continuously and linearly.

In the present invention, heat resistant treatment oil means the one of which the residue has less than 1,000 cst or less viscosity at a temperature of 25° C. after 0.5 g of it is taken into a 50 ml beaker heated at an increasing of 0.5° C./min. from 100° to 330° C. under the atmosphere of air.

The viscosity mentioned in this case can be measured using a rotating viscometer (CONTRABUS RHEOMAT 30) or a capillary viscometer.

The treatment oils can be applied by any method such as roller contact, spray application, foam application, dipping in treating oil bath and the like.

The amount of application of these treatment oils to a fiber is 0.01 to 10 wt %, preferably 0.05 to 5 wt %.

The thickness of winding after doubling can be set at one's option, from a viewpoint of working and operation, however, 10 to 100 mm is preferable.

(iii) Infusibilization of pitch fibers

In the present invention, fiber bundles are doubled aiming at enhancing their strength, and heat resistant doubling treatment oil is applied aiming at improving sizing properties of the fiber bundles during infusibilization, thus infusibilization is performed by passing the fiber bundles linearly and continuously through the oxygen rich gas atmosphere at a temperature of 350° C. or less, preferably at about 300° to 330° C.

This method reduces the time of infusibilization with an increase in the speed of the infusibilization reaction as a result of the high temperature and high partial oxygen pressure, since the fiber is infusibilized at such a high temperature by the use of oxygen rich gas. In addition, this method reduces the time of infusibilization with a selective increase in the speed of infusibilization of the fiber surface as a result of the high oxygen concentration, since the distribution of oxygen concentration towards the direction of the fiber radius during infusibilization varies depending on the oxygen concentration of the infusibilization atmosphere. According to the two effects stated above, this method can rapidly infusibilize the pitch fibers, at a high temperature and in a shorter time while preventing fusion of the fibers.

The oxygen rich gas in this invention means oxygen or a mixed gas of 30% or more oxygen content consisting oxygen and an inert gas(a rare gas, nitrogen, carbon dioxide, etc.). For instance, the mixed gas may be the one in which oxygen gas and air is mixed, or a mixture of oxygen gas and nitrogen gas. From viewpoints of furnace seals, the concentration of oxygen in the oxygen rich gas is preferable to be 90% or less, in particular, to bge 40 to 80%. If the concentration of oxygen exceeds 90%, the infusibilization reaction rushes too fast by heat accumulation in fiber bundles this is undesirable because breakage of fiber bundles, burning of fiber or explosion in the furnace is liable to occur. Less than 30% is also unpreferable since delaying or slowing of the reaction gives an unsatisfactory result.

At infusibilization, it is preferable to flush a fresh gas of the same kind as the atmosphere through the furnace, at a rate of 0.1 to 5 changes a minute and exhaust the old atmosphere. A part of the exhaust gas can be recycled, or reused by refining.

The atmosphere at infusibilization or thermesetting is preferably stirred, using a fan, and the speed of the wind is to be 0.1 to 10 m/sec, in particular, 0.5 to 5 m/sec. Such a compulsive stirring will promote the permeability of gas into the fiber bundles and filaments, eliminates inhomogeneity of temperature in the furnace and results in a homogeneous infusibilization.

Infusibilization can be made without applying any tension, it is, however, preferable to infusibilize while applying 0.001 to 0.2 g tension per a filament, in general to prevent generation of flaws made by rubbing the furnace bottom and wall due to the sagging of fiber bundles in the thermosetting furnace, and to improve the carbon fiber properties such as tensile strength and tensile elasticity modulus.

Infusibilization a thermosetting in the present invention as described in the above can reduce the time required for this step by ½ to 1/5 of the time required for the conventional infusibilization conducted an air atmosphere, which will make the time as long as the time in the subsequent heat treatment processing, and will enable the infusibilization processing to be conducted linearly and continuously a thread line with the heat treatment processing.

Infusibilization is performed by passing the fiber bundles into the infusibilization furnace, rewinding the doubled fiber bundles on bobbins. As another method, infusibilization is performed by passing the fiber bundles into the infusibilization furnace, doubling the pitch fiber bundles.

(iv) Heat treatment processing

Next, the infusibilized carbonaceous pitch fiber in the present invention is put into the atmosphere of an argon or a nitrogen gas, and heated to a temperature of 500° to 1,000° C., then precarbonation is performed to obtain a precarbonized carbon fiber. Subsequently the precarbonezed carbon fiber is carbonized by increasing the temperature in a range of 1,000° to 2,000° C., to obtain carbon fiber, and by increasing the temperature up to 2,000° to 3,000° C., to obtain so called graphite fiber.

The present invention does not restrict the details of the method for carbonizing and graphitizing, and various published methods can be applied.

The present invention doubles the carbonaceous pitch fiber bundles to increase the strength of fiber bundles, and thermosets the fiber bundles linearly and continuously as a thread line treatment after applying heat resistant doubling treatment oil, therefore no breakage of fiber bundles can not seen during thermosetting, and the strength of the fiber bundles is increased, result in enhancing the speed of the production. In addition, the thermosetting is performed under an oxygen rich atmosphere, and at a temperature of thermosetting increased up to 350° C., The time for thermosetting can be reduced as short as ½ to 1/5 of the time of imfusibilization under an air atmosphere. Under such conditions the difference of the time for the thermosetting and the subsequent heat treatment is reduced. Further as a result the size of the thermosetting furnace can be reduced to be shorter in length, and thermosetting can be performed economically without reducing the handling properties of the raw pitch fiber bundles and thermosat pitch fiber bundles, and the thermosetting and heat treatment processing can be performed linearly and continuously.

The present invention is a method to pass the fiber bundles into the thermosetting furnace linearly and continuously, thereby providing good appearance of the fibers and also the fibers free from irregularity of infusibilization and from inhomogeneity of the strength of the final products of carbon fiber or graphite fiber.

In particular, when an optically anisotropic carbonaceous pitch is used and prepared according to this invention, carbon fibers or graphite fibers with high strength and high elasticity modulus can be obtained.

EXAMPLES

The present invention is explained in more detail by examples, however, the present invention is not to be restricted by them.

EXAMPLE 1

A carbonaceous pitch containing about 55% optically anisotropic phase (AP) and having a softening point of 232° C. was used as a precursory pitch. This precursory pitch contained 16.1 wt % quinoline-insoluble component and 0.26 wt % ash, and exhibited a viscosity of 2.8 poises at 370° C. The pitch was melted in a melting tank having a capacity of 20 l, the temperature was controlled to be 370° C., and the pitch was fed at a flow rate of 20 ml per minute to a cylindrical continuous centrifuge having an effective rotor capacity of 200 ml. While the rotor temperature was being controlled at 370° C., the centrifugal force of 30,000 G was applied (G means a gravitational acceleration). A pitch having a large proportion of the optically anisotropic phase (pitch A) was continuously removed through an AP outlet, and a pitch having a large propotion of the optically isotropic phase(pitch I) through an IP outlet.

The obtained optically anisotropic pitch(pitch A) contained 98% of optically anisotropic phase. The softening point of the pitch was 265° C. and an amount of the quinoline-insoluble component contained in the pitch was 29.5%.

The obtained optically anisotropic pitch was introduced into melt spinning machine having a spinneret of 500 nozzle holes(a diameter of a nozzle hole: 0.3 mm) then the spinning was carried out at 355° C. under a nitrogen pressure of 200 mmHg.

The resulting pitch fiber was wound unto a stainless steel mesh bobbin of 200 mm width and 210 mm diameter for 10 minutes with winding speed of 500 m/min.

The pitch of traverse per 1 revolution of bobbin was 10 mm. No breadage of fiber were observed during the spinning. During the spinning, filaments were gathered to one fiber bundle by an air sucker and introduced to an oiling roller to supply a spinning treatment oil in an amount of about 0.5 weight % to fiber. The oil used was a methylphenylpolysiloxane having a viscosity of 14 cst at 25° C.

The pitch fibers were unwound from six bobbins then wound into one fiber bundle of 3,000 filaments on to a stainless steel bobbin under a condition of traverse pitch of 20 mm per one revolution of bobbin, wherein a methylphenylpolysiloxane (phenyl group content is 45 mole %) having a viscosity of 40 cst at 25° C. was used as a doubling treatment oil. The viscosity of the oil after a test of heat resisting property at 300° C. (the test described in this specification) was changed to 140 cst at 25° C., therefore, the heat resisting property of the oil was sufficient. A quantity of the supplied oil was 0.2% to a fiber.

The pitch fiber bundle wound on a bobbin thus obtained was unwound and introduced linearly and continuously as thread line treatment into an infusibilization or thermosetting furnace, having an oxygen rich atmosphere (oxygen:nitrogen = 1:1), the gradient of temperature of the infusibilization furnace was determined in such a way as to be 180° C. at an entrance of the furnace and the highest temperature of 330° C., wherein the hot atmosphere was forced to circulate by a fan. The temperature was raised from 180° C. to 330° C. in a rate of 10° C./min. The thermosetting treatment was carried out for 15 minutes.

During this treatment, the gases of the furnace atmosphere were substituted in a rate of 0.5 times/min. Wind velocity was 0.7 m/sec., and tension for the fiber bundle was 0.007 g per filament.

The unwinding of the pitch fiber bundle from the bobbins during the thermosetting or infusibilization, as well as infusibilization treatment itself, was carried out smoothly since no breadage of the fiber bundle were occurred.

After finishing the infusibilization, the same oil used for the doubling processing was supplied to the infusibilized pitch fiber bundles by a roller contact method.

The obtained infusible pitch fiber was heated to 1,500° C. in an nitrogen gas atmosphere to make carbon fiber. The diameter of the carbon fiber was 9.8 μm having a tensile strength of 3.0 G Pa and a tensile elastic modulus of 280 G Pa, respectively. Heating the carbon fiber to 2,500° C. in an argon gas atmosphere, formed a graphite fiber having a diameter of 9.7 μm, a tensile strength of 3.4 G Pa and tensile elastic modulus of 700 G Pa, respectively,.

EXAMPLE 2

The infusibilization treatment was carried out in the same manner as was carried out in Example 1 except using an oil consisting of a dimethylpolysiloxane having a viscosity of 40 cst at 25° C. and an iron octalate used as an antioxidant.

No breakage of the fiber occurred in the infusibilization furnace, therefore, the infusibilization treatment was smoothly carried out linearly and continuously. The viscosity of said oil after the test of heat resisting property at 330° C. was 160 cst at 25° C.

The diameter of a carbon fiber obtained by heating the above obtained infusibilized fiber at 1,500° C. was 9.8 μm, and a tensile strength and a tensile elastic modulus were 2.9 G Pa and 275 G Pa, respectively.

COMPARATIVE EXAMPLE 1

An infusibilization treatment was carried out in the same manner as was carried out in Example 1 except using an air as the atmosphere gas. In this case, the fiber bundle was fused and fell into taters, therefore, the fiber bundle had broken in the infusibilization furnace and a long fiber could not be obtained.

COMPARATIVE EXAMPLE 2

An infusibilization treatment was carried out in the same manner as was carried out in Example 1 except using an air as atmosphere gas and raising a temperature in a rate of 2.5° C./min. Although no breakage of fiber bundles occurred during the infusibilization treatment and long fibers were obtained, a long time such as 60 minutes was required to make the fiber infusible or thermoset.

The carbon fiber was obtained by heating the above obtained infusibilized pitch fiber at 1,500° C. in a nitrogen gas atmosphere. The diameter of the carbon fiber was 9.8 μm and a tensile strength and a tensile elastic modulus were 2.8 G Pa and 280 G Pa, respectively.

COMPARATIVE EXAMPLE 3

An infusibilization treatment was carried out in the same manner as was carried out in Example 1 except omitting the doubling process of the pitch fiber bundles. However, no long infusibilized fiber bundles were obtained since the pitch fiber bundles broke in the infusibilization furnace.

COMPARATIVE EXAMPLE 4

An infusibilization treatment was carried out in the same manner as was carried out in Example 2 except adding no antioxidant to the oil. In this case, the fiber bundle had fallen into taters in the infusibilization furnace, then the fiber bundle had broken and a long fiber was not obtained.

As a result of heat resisting property test at 330° C., the oil was gelled completely, therefore a viscosity cannot be measured.

COMPARATIVE EXAMPLE 5

An infusibilization treatment was carried out in the same manner as was carried out in Example 1 except using a methylphenyl-polysiloxane, (2 mole % content of phenyl group) having a viscosity of 90 cst at 25° C. as a doubling treatment oil.

The viscosity of the oil after heat resisting property test at 330° C. was 2,100 cst at 25° C. In this case, a long fiber bundle was obtained since the fiber bundle was broken in the infusibilization furnace during the treatment, however, a lot of fluff or dust was observed on a surface of the fiber bundle.

The diameter of the fiber after a carbonization at 1500° C. was 9.8 μm and a tensile strength and a tensile elastic modulus were 2.5 G Pa and 260 G Pa, respectively.

What is claimed is:

1. In the process for producing carbon fiber and graphite fiber comprising the steps of infusibilizing by thermosetting a pitch fiber obtained by spinning carbonaceous pitch, then carbonizing or graphitizing said infusibilized fiber, the improvement comprising the steps of: doubling said spun pitch fiber in bundles; adding a heat resistant doubling treatment oil of non-aqueous type during or after said doubling step wherein the heat resistant doubling treatment oil is selected from the group consisting of alkylphenylpolysiloxane containing 5 to 80 mole % of phenyl group, and dimethylpolysiloxane containing antioxidant which are both of the non-aqueous type and have less than 1,000 cst viscosity at 25° C. when 0.5 g of the oil is taken into a 50 ml beaker and heated by an increase in temperature of 0.5° C./min. from 100° to 330° C. under an air atmosphere; passing the doubled fiber bundles continuously and linearly as a thread line by applying 0.001 to 0.2 g tension per filament through a thermosetting furnace containing an oxygen rich gas with at least 30% oxygen content; and infusibilizing by thermosetting said fiber bundles at a temperature of less than about 350° C.

2. The process for producing carbon fiber and graphite fiber as claimed in claim 1, wherein the number of filaments after doubling the fiber bundles is in the range 500 to 100,000.

3. The process for producing carbon fiber and graphite fiber as claimed in claim 1, wherein the infusibilization temperature is 300° to 330° C.

4. The process for producing carbon fiber and graphite fiber as claimed in claim 1, wherein the oxygen rich gas contains a 40 to 80% oxygen concentration.

* * * * *